US011262707B2

(12) United States Patent
Oliveira et al.

(10) Patent No.: US 11,262,707 B2
(45) Date of Patent: Mar. 1, 2022

(54) MECHANICAL CONNECTION DEVICE

(71) Applicant: ROLEX SA, Geneva (CH)

(72) Inventors: Alexandre Oliveira, Amancy (FR); Arnaud Rosenzweig, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 294 days.

(21) Appl. No.: 15/983,283

(22) Filed: May 18, 2018

(65) Prior Publication Data

US 2018/0341229 A1 Nov. 29, 2018

(30) Foreign Application Priority Data

May 24, 2017 (EP) ..... 17172692

(51) Int. Cl.

| | |
|---|---|
| ***G04B 13/00*** | (2006.01) |
| ***G04F 7/08*** | (2006.01) |
| ***G04B 31/08*** | (2006.01) |
| ***G04D 3/00*** | (2006.01) |
| ***G04B 13/02*** | (2006.01) |
| ***G04B 15/14*** | (2006.01) |
| ***G04B 1/18*** | (2006.01) |

(52) U.S. Cl.

CPC ..... *G04F 7/0828* (2013.01); *G04B 1/185* (2013.01); *G04B 13/02* (2013.01); *G04B 15/14* (2013.01); *G04B 31/08* (2013.01); *G04D 3/0082* (2013.01); *G04D 3/0087* (2013.01); *G04F 7/0823* (2013.01)

(58) Field of Classification Search

CPC ..... G04F 7/0828; G04F 7/0823; G04B 31/08; G04B 13/02; G04B 15/14; G04B 1/185; G04D 3/0082; G04D 3/00; G04D 3/0087

See application file for complete search history.

(56) References Cited

U.S. PATENT DOCUMENTS

| | | | | |
|---|---|---|---|---|
| 5,042,017 | A * | 8/1991 | Stultz | G04C 3/007 200/11 R |
| 2008/0095968 | A1* | 4/2008 | Semon | G04D 3/0069 428/66.1 |
| 2008/0304370 | A1 | 12/2008 | Scheufele | |
| 2012/0051192 | A1 | 3/2012 | Steinmuller et al. | |

(Continued)

FOREIGN PATENT DOCUMENTS

| | | |
|---|---|---|
| CN | 102421936 A | 4/2012 |
| CN | 103959180 A | 7/2014 |
| CN | 205787620 U | 12/2016 |

(Continued)

OTHER PUBLICATIONS

Tooth/teeth Berners Dictionary—http://fhs.swiss/berner/index.php?l=en—Feb. 23, 2021.*

(Continued)

*Primary Examiner* — Sean Kayes

(74) *Attorney, Agent, or Firm* — Westerman, Hattori, Daniels & Adrian, LLP

(57) ABSTRACT

A mechanical connection device, in particular a mechanical connection device for a timepiece or a mechanical transmission device for a timepiece, includes a first part having a first area with at least a first micro-cavity; and a second part having a second area with at least a second micro-cavity, the first and second areas being in contact with one another in a mechanical connection configuration.

26 Claims, 14 Drawing Sheets

(56) References Cited

U.S. PATENT DOCUMENTS

| | | | | |
|---|---|---|---|---|
| 2014/0321250 | A1 | 10/2014 | Corthesy | |
| 2017/0298528 | A1* | 10/2017 | Marlot Doerr ..... | C25D 3/12 |

FOREIGN PATENT DOCUMENTS

| | | | |
|---|---|---|---|
| DE | 10 2009 046 647 | A1 | 5/2011 |
| EP | 2 015 145 | A1 | 1/2009 |
| EP | 2 085 832 | A1 | 8/2009 |
| EP | 3 002 635 | A1 | 4/2016 |
| EP | 3032358 | A1 | 6/2016 |
| EP | 3 051 364 | A1 | 8/2016 |
| EP | 3 067 757 | A1 | 9/2016 |

OTHER PUBLICATIONS

European Search Report and Written Opinion dated Nov. 28, 2017 issued in counterpart application No. EP17172692; w/ English machine translation (15 pages).
Office Action dated Nov. 9, 2020, issued in counterpart EP Application No. 17172692.0. (5 pages).
Office Action dated Jan. 26, 2021, issued in counterpart CN Application No. 201810502406.8, with English Translation. (22 pages).

* cited by examiner

MECHANICAL CONNECTION DEVICE

This application claims priority of European patent application No. EP17172692.0 filed May 24, 2017, which is hereby incorporated herein in its entirety.

The invention relates to a mechanical connection device for a timepiece. The invention also relates to a timepiece mechanism comprising a connection device of this type. The invention further relates to a timepiece movement comprising a device of this type or a mechanism of this type. The invention also relates to a timepiece comprising a device or a mechanism or a movement of this type.

Timepiece couplings are known, in particular vertical couplings, inside which two components can be rendered integral with friction under the effect of a force produced by a return means. However, solutions of this type are not optimal with respect to the torque transmitted by the coupling relative to the force produced by the return means. It is thus difficult to increase the torque transmitted by a timepiece coupling, since the force produced by the return means can not be increased indefinitely, in particular in relation to energy considerations, mechanical stresses, and dimensions. In addition, the timepiece couplings known in the prior art can be subject to risks of fluttering or butting, or blocking.

There is known from document EP2015145 a device for vertical coupling with friction for a chronograph, which is designed such as to increase the friction between the lower and upper disks, independently from the size of the coupling spring. The particular feature of this coupling consists in the fact that the transmission torque between the disks is derived from the adhesion of an O-ring seal made of a viscoelastic material, which is interposed between the lower and upper disks of the device. A solution of this type is not optimal because of the properties of the seal, which will change over a period of time, and are liable to detract from the torque resistance of the coupling. A system for transmission of wheels by adhesion is known from patent application EP3051364. In this case, movement is transmitted exclusively by the adhesion of the peripheral parts of drive and driven wheels. For this purpose, resilient arms of the drive wheel are pre-stressed, and have a size such as to guarantee adequate adhesion of the peripheral parts of each of the wheels. A solution of this type could make it possible to eliminate the risks of fluttering, in particular within the specific context of a chronograph horizontal coupling device, but without excluding completely the risks of untimely sliding, in particular in the event of impacts. In addition, a solution of this type requires the use of specific materials with high coefficients of friction and resilient elements in order to ensure permanent and sufficient contact pressure between the peripheral parts of each of the wheels.

Timepiece components, the surface state of which is modified by means of a laser, are also known in the prior art. Patent application EP3067757 discloses for example a micro-mechanical part comprising locally at least one area which is micro-structured by means of a laser, with this micro-structured area having a three-dimensional surface formed by micro-cavities which are configured to act as a reservoir for a lubricant substance. Patent application EP3002635 for its part describes a method for production of a spring element, which has the advantage of modifying the resilient and motive properties of the element by means of at least partial controlled structuring of its surface.

The objective of the invention is to provide a connection device which makes it possible to eliminate the disadvantages previously mentioned, and to improve the devices known in the prior art. In particular, the invention proposes a mechanical connection device which can be maximized independently from return forces which act on elements of the mechanical connection device.

According to the invention, a connection device is defined by point 1 below.

1. A mechanical connection device, in particular a mechanical connection device for a timepiece or a mechanical transmission device for a timepiece, comprising:
   - a first part comprising a first area with at least a first micro-cavity; and
   - a second part comprising a second area with at least a second micro-cavity,
     - the first and second areas being in contact with one another in a mechanical connection configuration.

Different embodiments of a connection device are defined by points 2 to 9 and 12 below.

2. The device as defined in the preceding point, wherein the first micro-cavities are micro-grooves and/or the second micro-cavities are micro-grooves.
3. The device as defined in one of the preceding points, wherein the first micro-cavities have a depth of less than 100 μm, or less than 50 μm, or less than 25 μm, and/or the second micro-cavities have a depth of less than 100 μm, or less than 50 μm, or less than 25 μm, and/or the first and second micro-cavities have the same depth or substantially the same depth, and/or the first micro-cavities have a width of less than 200 μm, or less than 150 μm, or less than 100 μm, and/or the second micro-cavities have a width of less than 200 μm, or less than 150 μm, or less than 100 μm, and/or the first and second micro-cavities have the same width or substantially the same width.
4. The device as defined in one of the preceding points, wherein the micro-cavities have flanks forming an angle ($\alpha$) of between 90° and 160° from the bottoms of the first micro-cavities, and/or the second micro-cavities have flanks forming an angle ($\alpha$) of between 90° and 160° from the bottoms of the second micro-cavities.
5. The device as defined in one of the preceding points, wherein the first micro-cavities and the second micro-cavities, in particular the flanks of the first micro-cavities and of the second micro-cavities, are oriented perpendicularly, or substantially perpendicularly, to the forces transmitted from the first part to the second part at the contact between the first and second parts, or the first micro-cavities and the second micro-cavities are oriented parallel, or substantially parallel, to the forces transmitted from the first part to the second part at the contact between the first and second parts.
6. The device as defined in one of the preceding points, wherein the first part is a part which is fitted such as to be mobile relative to a frame, in particular a first disk or a first wheel, and/or the second part is a part which is fitted such as to be mobile relative to the frame, in particular a second disk or a second wheel or a spring, or it is a part fitted fixed relative to the frame, and in particular is a frame blank.
7. The device as defined in one of the preceding points, wherein the first area forms a portion of a first surface of the first part, in particular a first surface which is cylindrical or frusto-conical or flat, and/or the second area forms a portion of a second surface (of the second part, in particular a second surface which is cylindrical or frusto-conical or flat.
8. The device as defined in the preceding point, wherein the portion of first surface is micro-structured on the interior or on the exterior, and/or the portion of second surface is micro-structured on the interior or exterior.

9. The device as defined in one of the preceding points, wherein it comprises a return element, in particular an element for resilient return of the first area into contact against the second area.

12. A device obtained by implementation of the method as defined in point 10 or 11.

According to the invention, a production method is defined by point 10 below.

10. A method for production of a device as defined in one of the preceding points, wherein it comprises the following steps:
    - treating, in particular texturizing or structuring the first part by means of a laser, in particular a femtosecond laser, in order to obtain the first micro-cavities; and
    - treating, in particular texturizing or structuring the second part by means of a laser, in particular a femtosecond laser, in order to obtain the second micro-cavities.

An embodiment of a production method is defined by point 11 below.

11. The production method as defined in the preceding point, wherein it comprises a prior step of coating of the first area with a friction-reduction layer, which in particular is based on carbon, and in particular is based on graphene, and/or a prior step of coating of the second area with a friction-reduction layer, which in particular is based on carbon or graphene, and in particular is based on graphene.

According to the invention, a timepiece mechanism is defined by point 13 below.

13. A timepiece mechanism, in particular a chronograph coupling, in particular a chronograph horizontal or vertical or radial coupling, a mechanism for correction at the setting stem, a mechanism for correction of the date, or a barrel, comprising a mechanical connection device as defined in one of points 1 to 9 and 12.

According to the invention, a timepiece movement is defined by point 14 below.

14. A timepiece movement comprising a mechanical connection device as defined in one of points 1 to 9 and 12, or a mechanism as defined in point 13.

According to the invention, a timepiece is defined by point 15 below.

15. A timepiece, in particular a wristwatch, comprising a movement as defined in the preceding point, or a mechanism as defined in point 13, or a mechanical connection device as defined in one of points 1 to 9 and 12.

The appended figures represent by way of example different embodiments of a timepiece according to the invention.

FIGS. 24 to 27 views of a first variant embodiment of an eighth embodiment of a timepiece according to the invention comprising a first variant embodiment of an eighth embodiment of a mechanical connection device.

Figure 28:
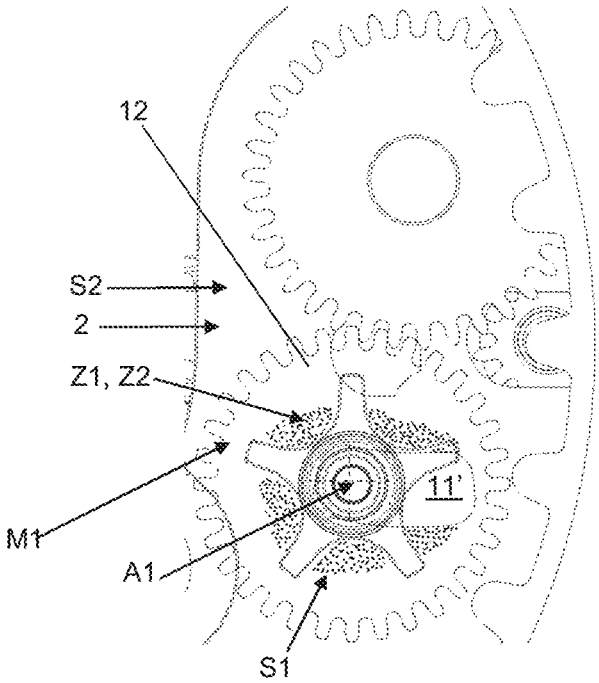

FIG. 28 is a view of a second variant embodiment of the eighth embodiment of a timepiece according to the invention comprising a second variant embodiment of the eighth embodiment of a mechanical connection device.

A first embodiment of a timepiece 130 is described hereinafter with reference to FIGS. 1 to 10. The timepiece is for example a watch, in particular a wristwatch. The timepiece comprises a timepiece movement 120. The movement is for example a mechanical movement. The movement comprises a timepiece mechanism 110, for example a chronograph mechanism or a chronograph module or a correction mechanism. The timepiece mechanism 110 comprises a mechanical connection device 100.

The mechanical connection device 100 is for example a mechanical connection device for a timepiece or a mechanical transmission device for a timepiece.

The mechanical connection device 100 comprises:
- a first part 1 comprising a first area Z1 with at least a first micro-cavity C1; and
- a second part 2 comprising a second area Z2 with at least a second micro-cavity C2, the first and second areas being in contact with one another in a mechanical connection configuration.

In the first embodiment, the two parts 1, 2 or components 1, 2 have been micro-structured at least at a first area Z1 and a second area Z2, respectively. The first part is fitted such as to be mobile relative to a frame of the movement, and the second part is also fitted such as to be mobile relative to a frame of the movement. The first part 1 is for example a drive part, whereas the second part 2 is for example a driven part.

In this first embodiment, the first part 1 is pivoted around an axis A1, and the second part 2 is pivoted around an axis A2. Preferably, the axes A1, A2 coincide, such as to form a mechanical connection device 100 which is a mechanical transmission device or a mechanical coupling device, which for example is integrated in a chronograph vertical coupling device.

Preferably, the first part is a first disk with an axis A1, and the second part is a second disk with an axis A2. When the chronograph is interlocked, the second part 2 drives a counting chain of the chronograph. The second part 2 is then placed against a runner 1 formed by the first part which is engaged with the finishing chain of the timepiece movement.

A return element 3, in particular a resilient return element such as a spring, returns the first and second parts against one another, and in particular the first and second areas against one another.

Figure 1:
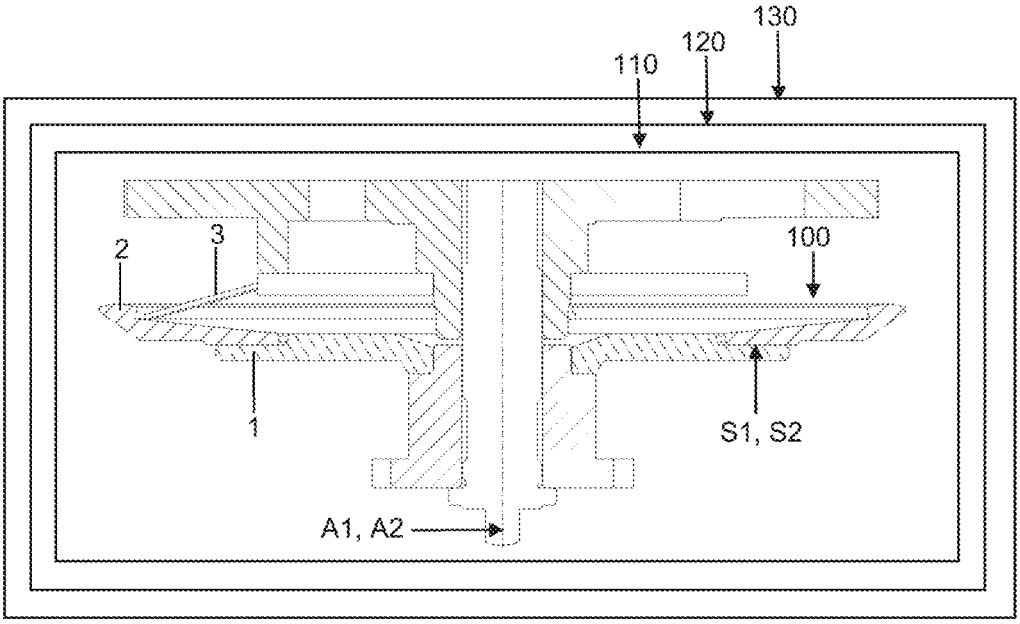
FIGS. 1 to 10 are views of a first embodiment of a timepiece according to the invention comprising a first embodiment of a mechanical connection device.
Figure 2:
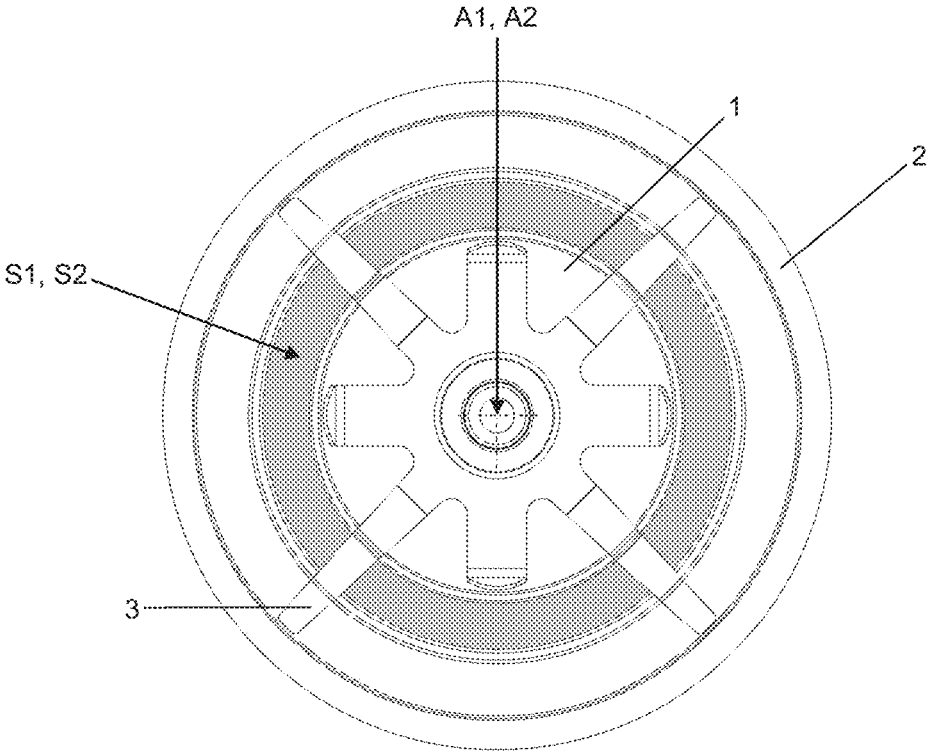
Figure 3:
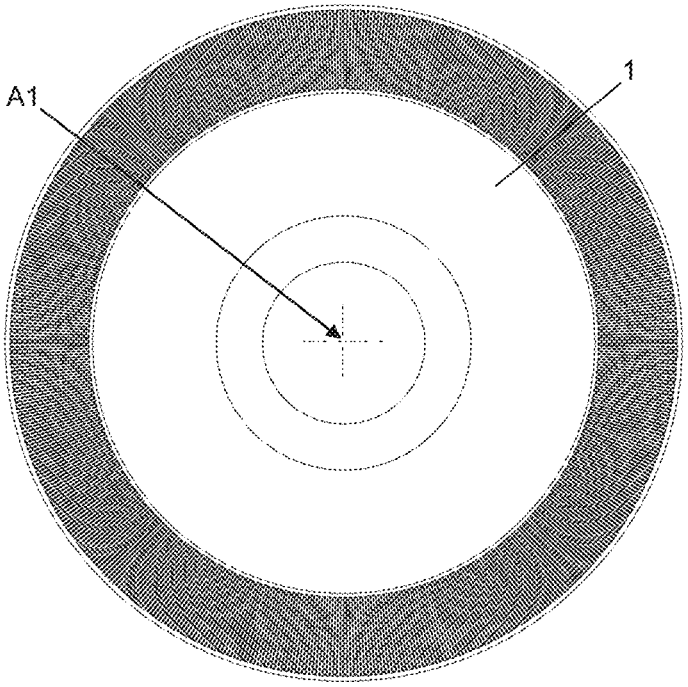
Figure 4:
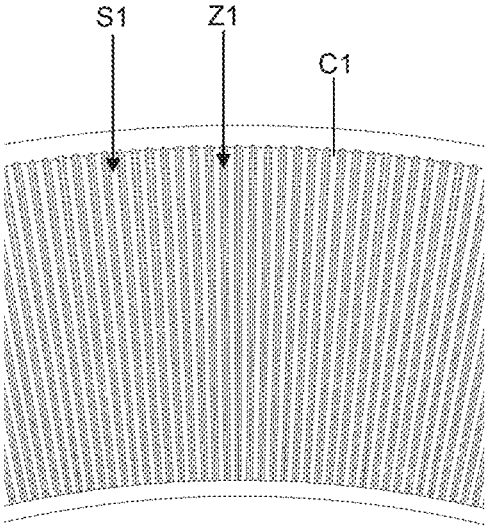
Figure 5:
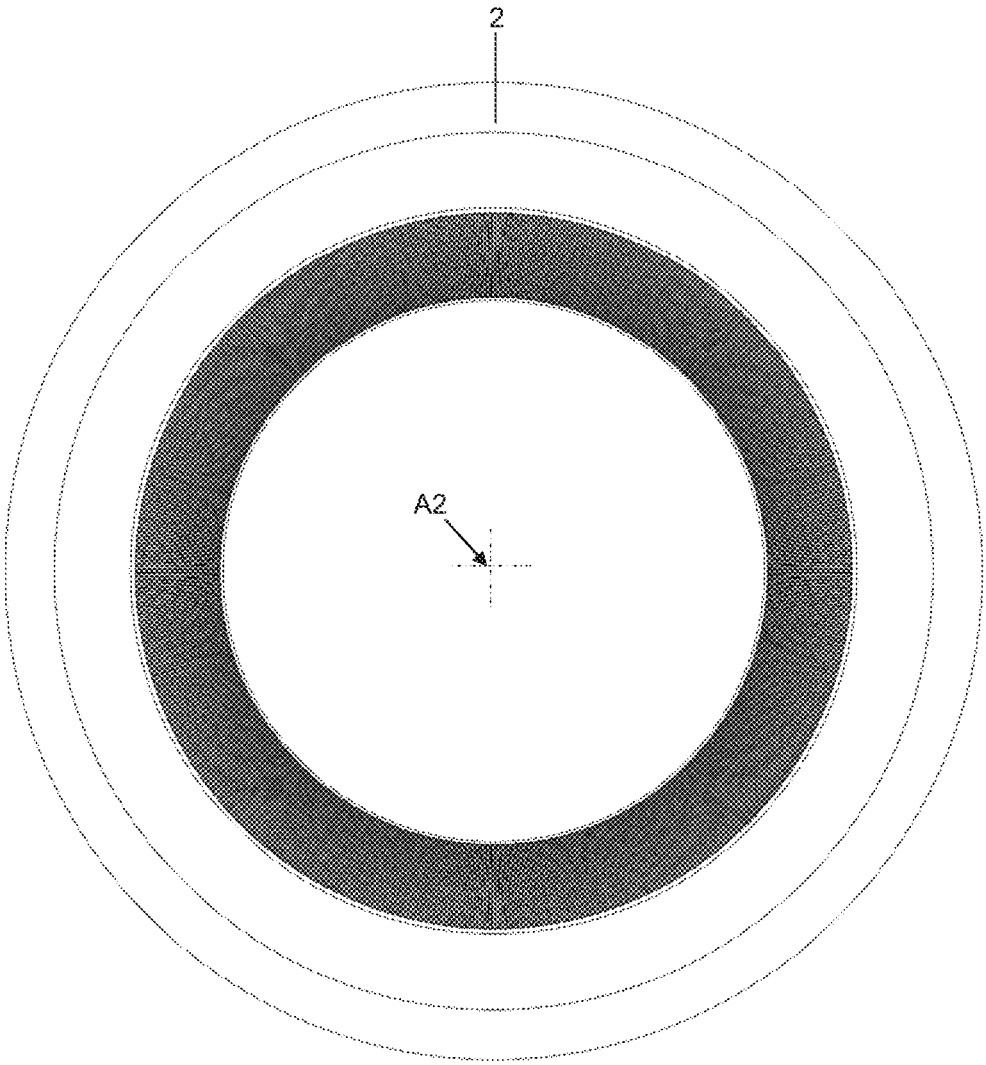
Figure 6:
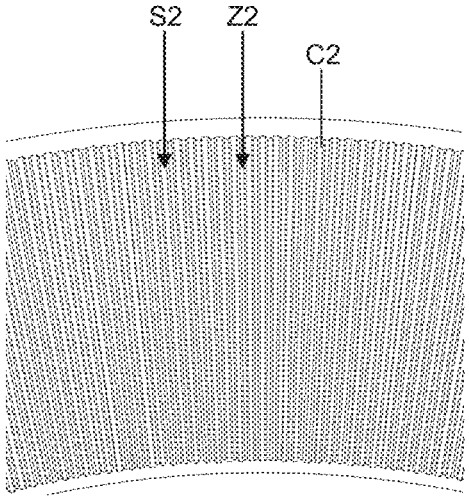
Figure 7:
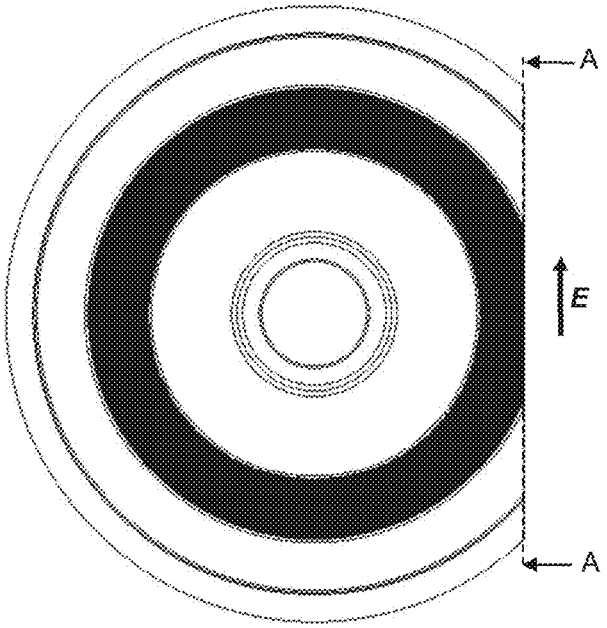
Figure 8:
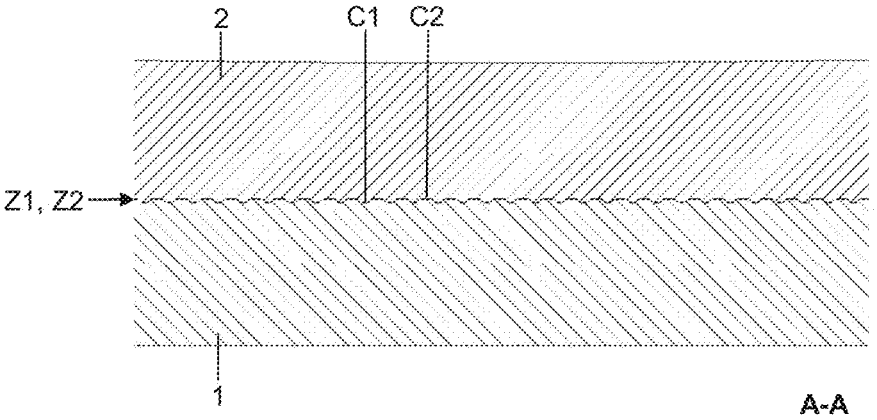

In this particular construction, the first area Z1 and the second area Z2 of the components 1 and 2 are represented tinted in grey in FIG. 2. The first and second areas can come into contact. The first and second areas Z1, Z2 are arranged respectively according to a first surface S1 and according to a second surface S2. The S1 surface is flat, and perpendicular, or substantially perpendicular, to the axis A1. The surface S2 is flat, and perpendicular, or substantially perpendicular to the axis A2. The first area Z1 is a flat ring, and second area Z2 is a flat ring. Preferably, the two flat rings have substantially the same dimensions or the same extents. The first area Z1 and the second area Z2 cover at least partially respectively the surfaces S1 and S2.

The first area forms a portion of a first surface S1 of the first part, in particular a first surface which is cylindrical or frusto-conical or flat. The second area forms a portion of a second surface S2 of the second part, in particular a second surface which is cylindrical or frusto-conical or flat.

The first area Z1 and second area Z2 comprise in this example in particular respectively approximately 180 micro-cavities C1 and C2. Preferably, the geometries of the micro-cavities C1 and the geometries of the micro-cavities C2 are identical. In this particular construction, the micro-cavities can be micro-furrows or micro-grooves hollowed radially at regular intervals. The depth P1 of the micro-cavities C1 can be 8 μm. The width L1 of the micro-cavities C1 can develop from 30 μm to 40 μm along the radial dimension of the first and second areas Z1, Z2. The depth P2 of the micro-cavities C2 can be 8 μm. The width L2 of the micro-cavities C2 can develop from 30 μm to 40 μm along the radial dimension of the first and second areas Z1, Z2.

Preferably, in this embodiment, the first micro-cavities C1 and the second micro-cavities C2, in particular the flanks F1 of the first micro-cavities and the flanks F2 of the second micro-cavities C2, are oriented perpendicularly, or substantially perpendicularly, to the forces E transmitted from the first part to the second part at the contact between the first and second parts, in particular at the areas Z1, Z2. Thus, in this first embodiment, the micro-cavities C1 and C2 are micro-grooves which extend radially relative to the axes A1 and A2, i.e. which are oriented radially relative to the axes A1 and A2.

In this embodiment, when the first and second areas are in contact with one another, i.e. in a configuration of mechanical connection, the areas Z1 and Z2 are in contact with one another at the flanks of the micro-cavities of an area, i.e. flanks of the micro-cavities of one area come into contact with flanks of the micro-cavities of the other area. Optionally, tops between micro-cavities of one area can also come into contact with bottoms of micro-cavities of the other area.

In this embodiment, the flanks F1 of the micro-cavities C1 form an angle α with the bottoms 91 of the micro-cavities C1. Similarly, the flanks F2 of the micro-cavities C2 form an angle α with the bottoms 92 of the micro-cavities C2. Preferably, the angle α can be a right-angle or an obtuse angle. The angle α is defined such as to transmit the forces E adequately between the first part and the second part, whilst permitting coupling of the parts 1 and 2, i.e. contact of the flanks F1 against the flanks F2.

The micro-cavities C1, C2 can be symmetrical or non-symmetrical, according to the orientation of the forces E to be transmitted from the part 1 to the part 2.

The bottoms 91 of the micro-cavities C1 and the bottoms of the micro-cavities C2 can have the form of regulated surfaces, and in particular they can be planes. Alternatively, they can be reduced to a an edge or substantially an edge. The tops 93 between two micro-cavities C1 and the tops 94 between two micro-cavities C2 can have the form of regulated surfaces, and in particular they can be planes. Alternatively they can be reduced to an edge or substantially an edge.

A regulated surface is a surface via each point of which there passes a straight line, known as a generatrix, contained on the surface.

Figure 11:
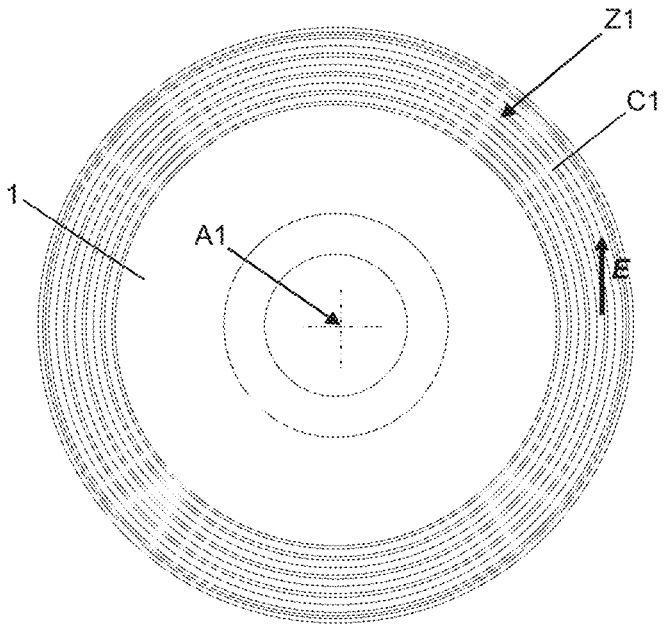
FIGS. 11 to 13 are views of a second embodiment of a timepiece according to the invention comprising a second embodiment of a mechanical connection device.
Figure 12:
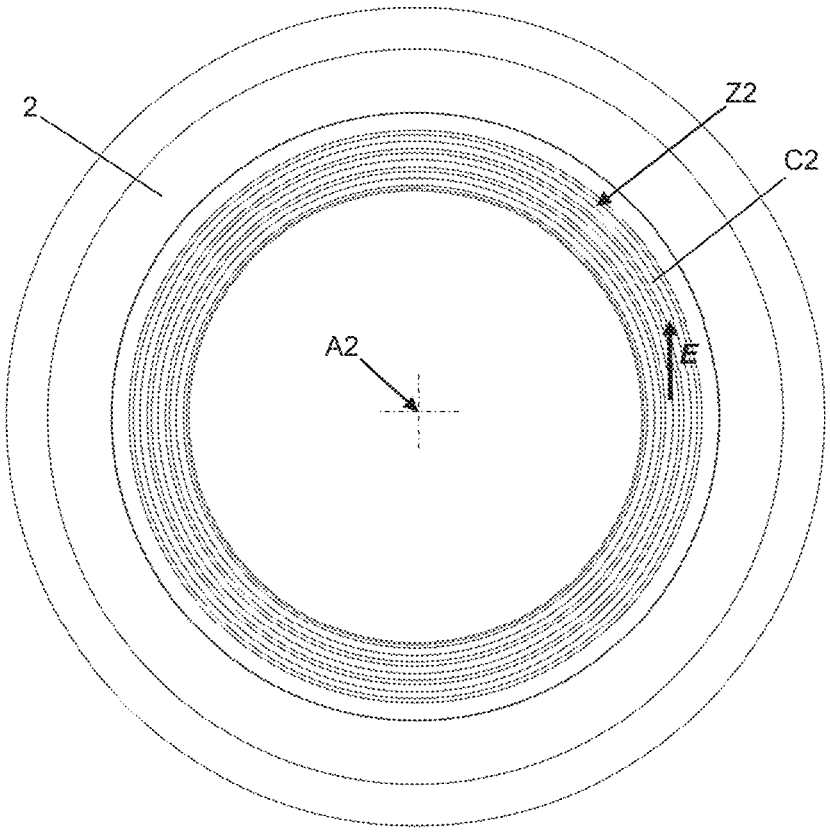
Figure 13:
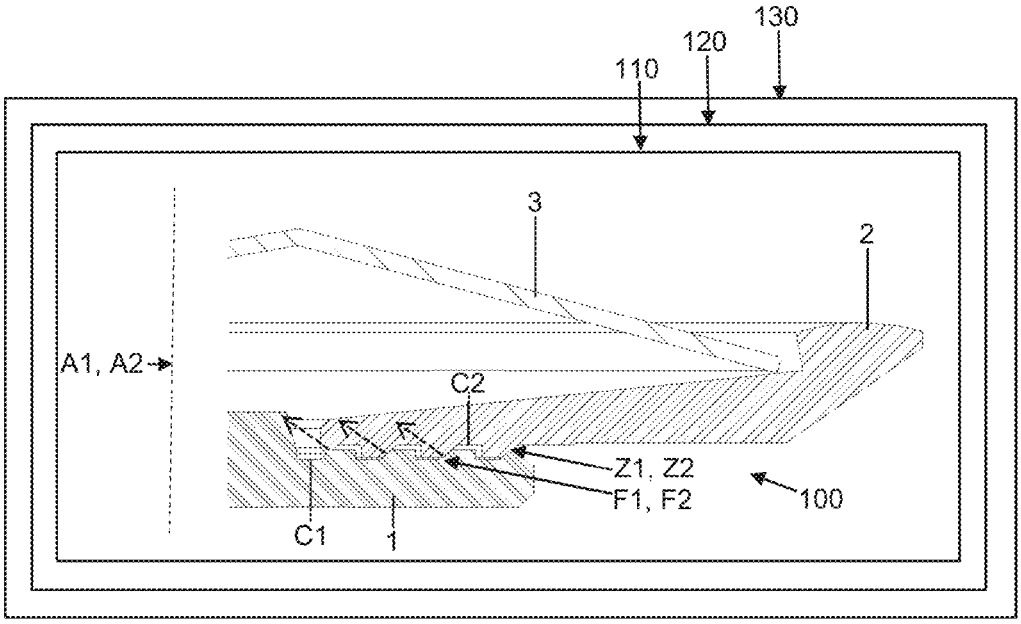

A second embodiment of a timepiece 130 is described hereinafter with reference to FIGS. 11 to 13. The timepiece comprises a timepiece movement 120. The movement comprises a timepiece mechanism 110, such as, for example, a chronograph mechanism or a chronograph module or a correction mechanism.

The timepiece mechanism 110 comprises a mechanical connection device 100.

The second embodiment differs from the first embodiment in that the first micro-cavities C1 and the second micro-cavities C2 are oriented parallel, or substantially parallel, to the forces E transmitted from the first part to the second part at the contact between the first and second parts. Thus, in this second embodiment, the micro-cavities C1 and C2 are circular micro-grooves or micro-furrows which extend concentrically to the axes A1 and A2. In this embodiment, the flanks F1 of the micro-cavities form with the bottoms 91 of the micro-cavities an angle α which is strictly obtuse. Similarly, the flanks F2 of the micro-cavities C2 form with the bottoms 92 of the micro-cavities an angle α which is strictly obtuse.

In this embodiment, when the first and second areas are in contact with one another, i.e. in a mechanical connection configuration, the areas Z1 and Z2 are in contact with one another at the flanks of their micro-cavities. Preferably, the tops of the micro-cavities of one area do not come into contact with the bottoms of the micro-cavities of the other area.

Because of the angle α formed between the bottoms and the flanks of the micro-cavities, the axial force which is exerted by the spring 3, and returns the areas Z1 and Z2 into contact with one another, is taken up at the flanks by forces which are inclined relative to the axes A1 and A2, i.e. which have a radial component. This radial component is all the greater, the more the angle α approaches 90°. The radial component makes it possible to maximize the mechanical transmission torque which can be transmitted from one of the parts 1 to the other one of the parts 2.

Figure 15:
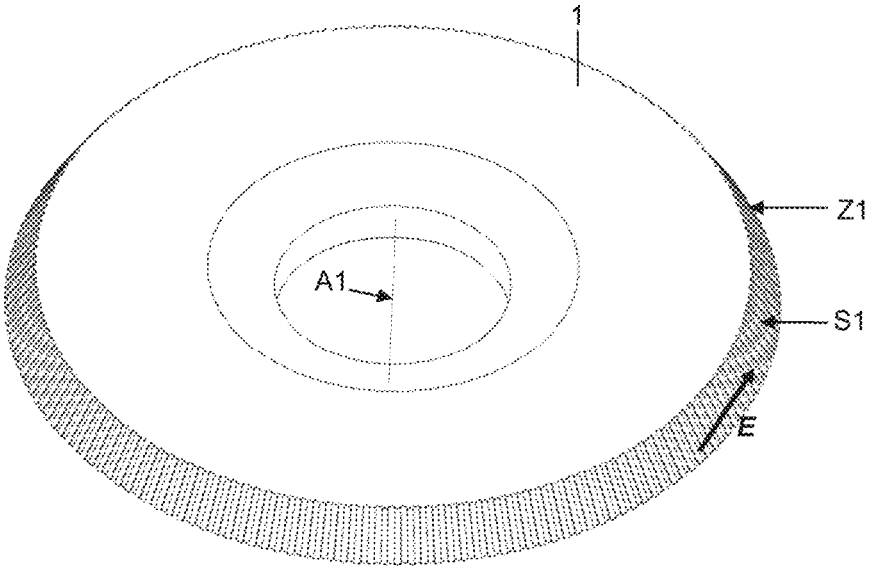
Figure 16:
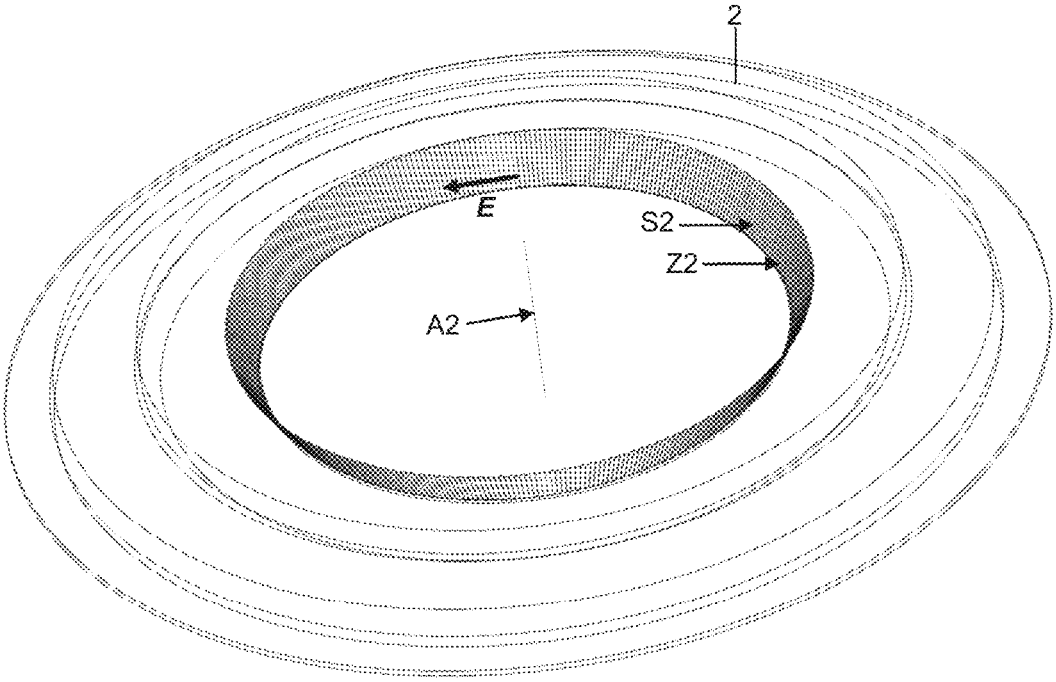

A third embodiment of a timepiece part 130 is described hereinafter with reference to FIGS. 14 to 16. The timepiece comprises a timepiece movement 120. The movement comprises a timepiece mechanism 110, for example a chronograph mechanism or a chronograph module or a correction mechanism.

The timepiece mechanism 110 comprises a mechanical connection device 100.

The third embodiment differs from the first and second embodiments in that the surfaces S1 and S2 on which the areas Z1 and Z2 are formed, with the micro-cavities C1 and C2, are not flat surfaces. In fact, in this third embodiment, the surfaces S1 and S2 are advantageously each a surface of revolution, in particular a cone of revolution S1, S2. The areas Z1 and Z2 are each a frustum of this surface of revolution, in particular a frustum of this cone of revolution. The surfaces S1 and S2 are advantageously identical.

Figure 14:
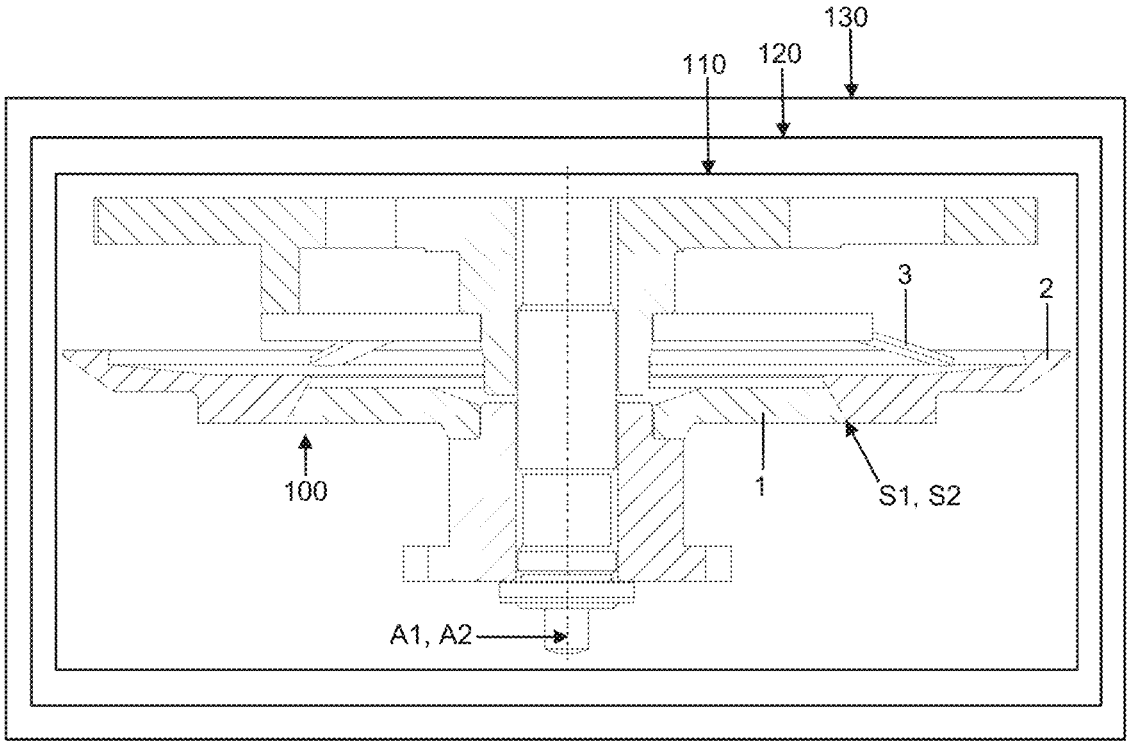
FIGS. 14 to 16 are views of a third embodiment of a timepiece according to the invention comprising a third embodiment of a mechanical connection device.

FIG. 14 is a view in cross-section in a coupling configuration or mechanical connection configuration, of the third embodiment of a mechanical connection device of the coupling device type. This coupling device is of the vertical type. This coupling device has the specific feature of being of the conical type. In the manner of the coupling device represented in FIGS. 1 and 2, a disk 2 can drive the counting chain of the chronograph, and can be placed against a runner 1, engaged with the finishing chain of the timepiece movement, under the presser effect of a coupling spring 3.

As in the first and second embodiments, the areas Z1 and Z2 can have or not the same number of micro-cavities C1, C2. The geometries of the micro-cavities C1, C2 can be identical or non-identical.

Preferably, in this third embodiment, the first micro-cavities C1 and the second micro-cavities C2, in particular the flanks F1 of the first micro-cavities and the flanks F2 of the second micro-cavities C2, are oriented perpendicularly, or substantially perpendicularly, to the forces E transmitted from the first part to the second part at the contact between the first and second parts. Thus, in this third embodiment, the micro-cavities C1 and C2 are micro-grooves which extend preferably in the direction of the tops of the surfaces S1 and S2. The surface S1 is preferably an outer surface, i.e. a surface of the first part which forms a convexity. The surface S2 is preferably an inner surface, i.e. a surface of the second part which forms a concavity.

Thus, in this third embodiment, the first area Z1 is formed on the first outer surface S1, and the second area Z2 is formed on the second inner surface S2.

Figure 17:
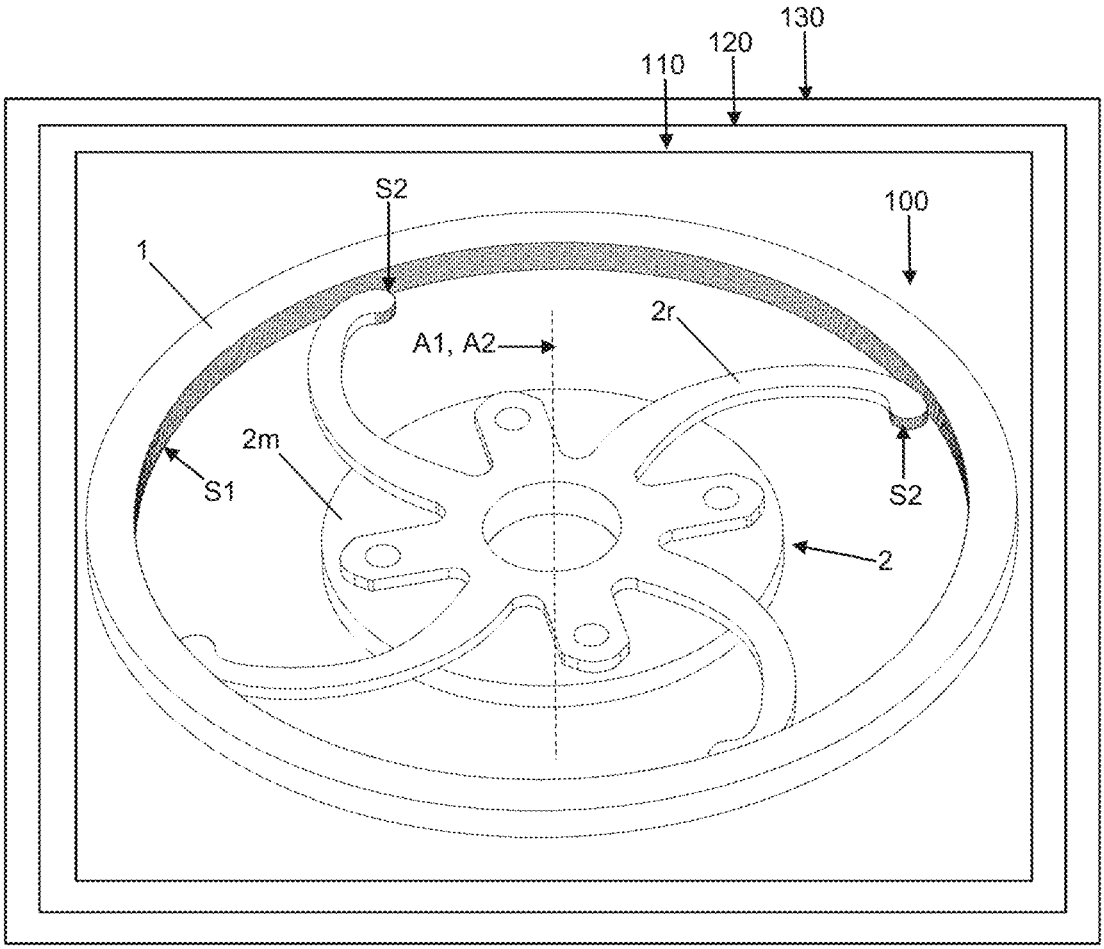
FIGS. 17 and 18 are views of a fourth embodiment of a timepiece according to the invention comprising a fourth embodiment of a mechanical connection device.
Figure 18:
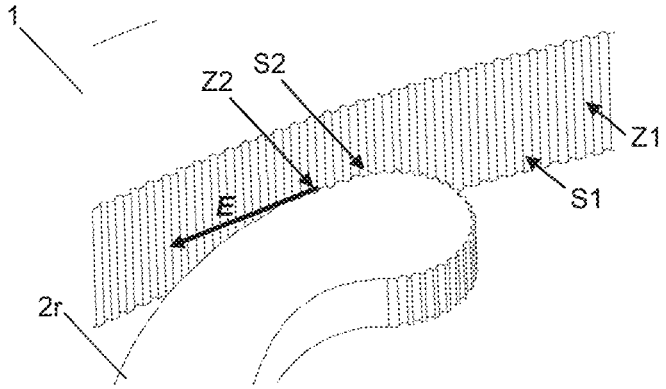

A fourth embodiment of a timepiece 130 is described hereinafter with reference to FIGS. 17 and 18. The timepiece comprises a timepiece movement 120. The movement comprises a timepiece mechanism 110, for example a chronograph mechanism or a chronograph module or a correction mechanism.

The timepiece mechanism 110 comprises a mechanical connection device 100.

The fourth embodiment differs from the preceding embodiments in that it is applied to a radial coupling device, the operating principle of which is such as that described for example in patent application EP2085832. More particularly, a drive component 1 can drive a driven component 2 comprising a spring 2*r* which is integral with a disk 2*m*, and can produce a radial clamping force against a cylindrical surface S1 of the component 1. For this purpose, the spring 2*r* comprises one or a plurality of resilient arms provided with surfaces S2 which can come into contact with the surface S1 of the component 1. In a first variant of actuation of the coupling device, the spring 2*r* can be actuated by a connected actuation device, such that the drive component 1 can lead the driven component 2 in one or two directions of rotation under the effect of the presser force of the spring 2*r*. Alternatively, in a first direction of rotation of the drive component, the resilient arms can bend and the drive component turns without entraining the driven component. In a second direction of rotation of the drive component, there can in particular be butting of the resilient arms of the spring 2*r* at their ends which are in contact with the drive component, and the rotation of the drive component drives that of the driven component.

In this case, driven component 2 means the component 2 which includes the disk 2*m* and the spring 2*r*. The component 2 can also be in the form of a component in a single piece which has a return spring function.

The driving and driven natures of the components can be inverted.

In this fourth embodiment, the first area Z1 is preferably a portion of a cylinder of revolution S1 with an axis of revolution A1, and the second area(s) Z2 advantageously consist(s) of portions of a regulated surface S2 with generatrices parallel to the axis A1 of the cylinder of revolution S1. The number of areas Z2 preferably corresponds to the number of arms of the spring 2*r*.

In this fourth embodiment, the first area Z1 is preferably micro-structured on the interior, and the second area Z2 is preferably micro-structured on the exterior. Thus, the two micro-structured areas can come into contact during the operation of the device.

Figure 19:
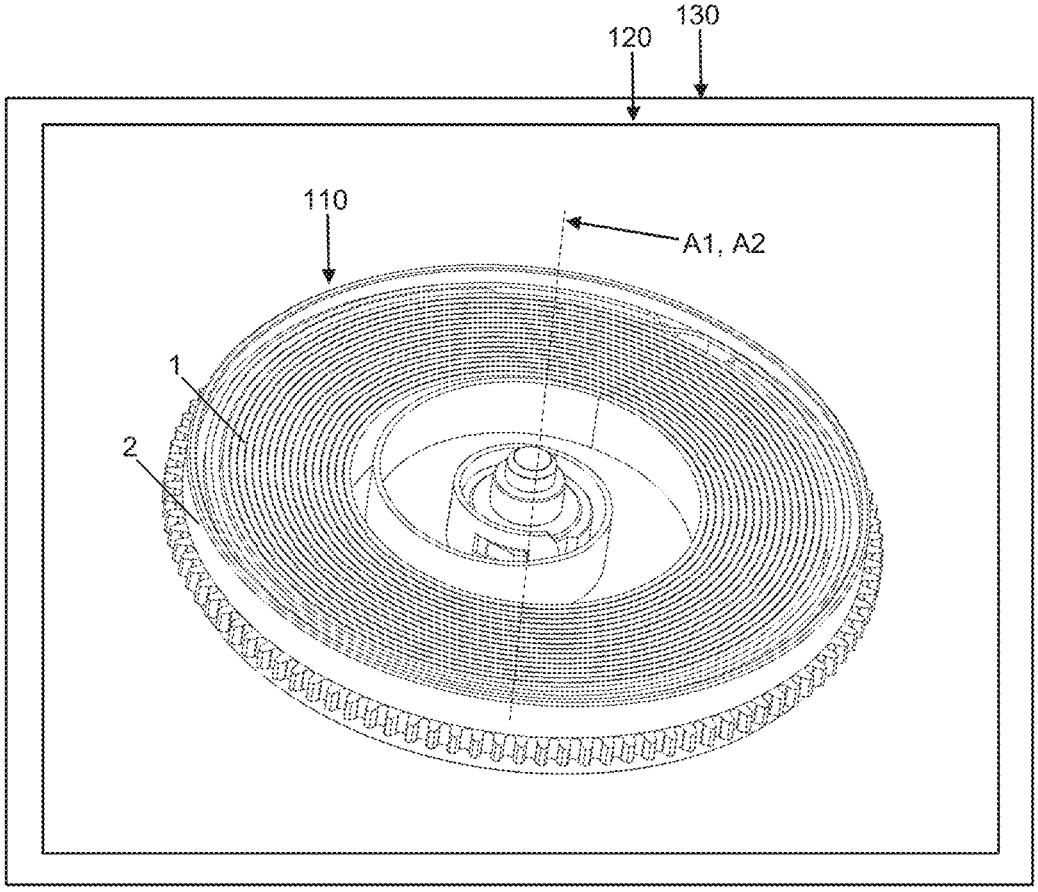
FIGS. 19 and 20 are views of a fifth embodiment of a timepiece according to the invention comprising a fifth embodiment of a mechanical connection device.
Figure 20:
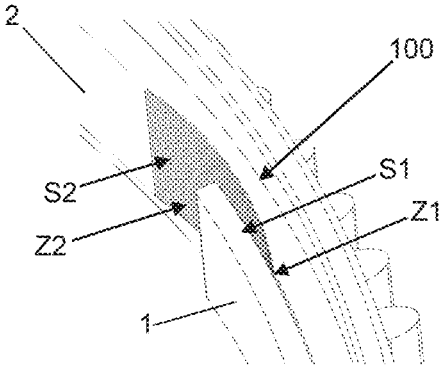

A fifth embodiment of a timepiece 130 is described hereinafter with reference to FIGS. 19 and 20. The timepiece comprises a timepiece movement 120. The movement comprises a timepiece mechanism 110, such as, for example, a timepiece barrel.

The timepiece mechanism 110 comprises a mechanical connection device 100.

The fifth embodiment differs from the preceding embodiments in that it is applied to a mechanical connection of a barrel spring to a barrel drum. In particular, the mechanical connection device makes it possible to control the torque of a timepiece barrel spring, in particular inside a barrel of a watch with automatic winding. The solution consists of coupling the barrel spring with friction to the inner wall of the barrel drum. For this purpose, one or a plurality of micro-structured areas Z2 are provided in an inner wall S2 of the barrel drum 2, such as to control, and in particular maximize, as far as possible, the sliding torque of the spring relative to the drum. Preferably, the spring, in particular a flange 1 of the spring is also micro-structured such that the micro-cavities C1 and C2 formed respectively in the spring and the drum cooperate by contact. Alternatively, the micro-structures formed on the inner wall of the drum can be formed at least partly on the walls S2 of at least one notch formed in the drum, as represented in FIG. 20.

In conventional operation of the movement, the spring 1 in this case acts as a drive component of the barrel drum 2 under the effect of its unwinding. According to the manual or automatic winding of the movement, and beyond a maximum predefined winding torque of the spring 1, the device is designed to separate the spring 1 from the drum 2.

Figure 21:
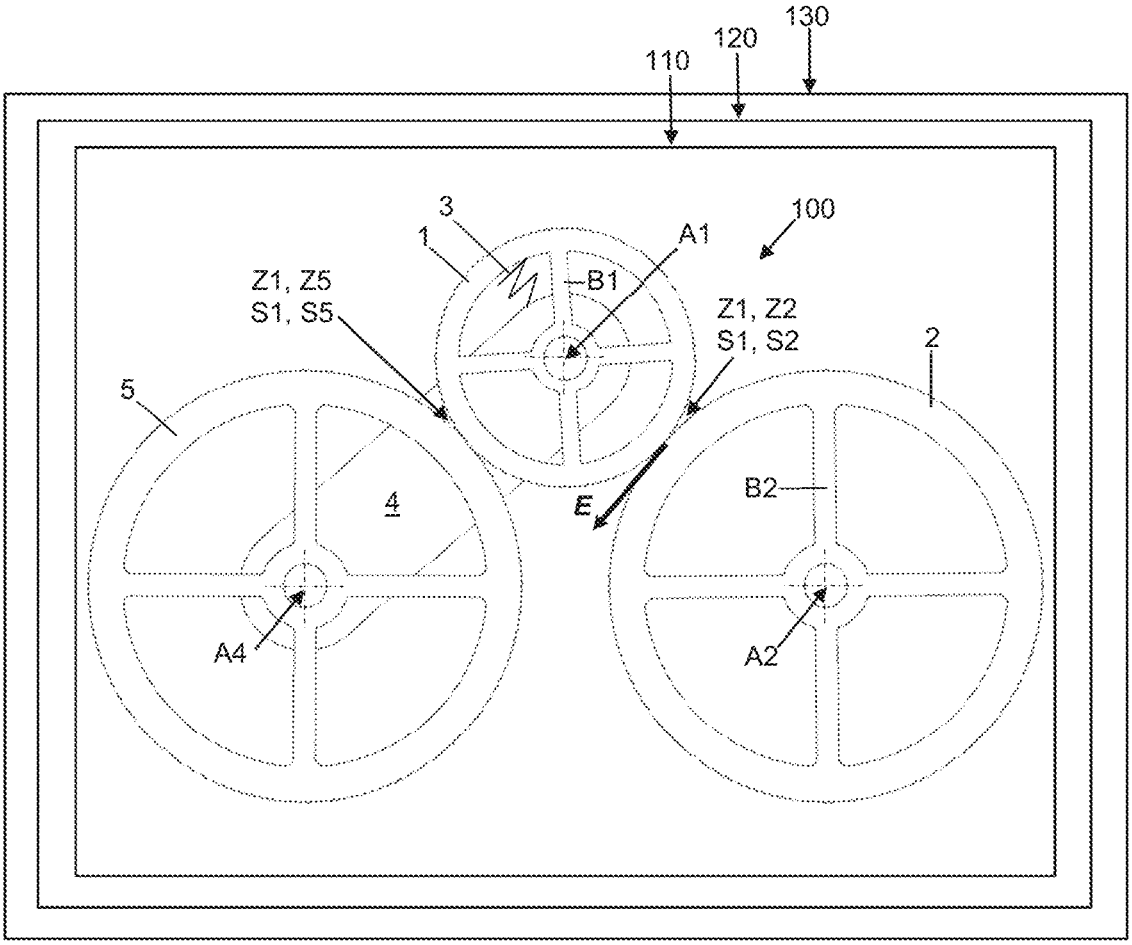
FIGS. 21 and 22 are views of a sixth embodiment of a timepiece according to the invention comprising a sixth embodiment of a mechanical connection device.
Figure 22:
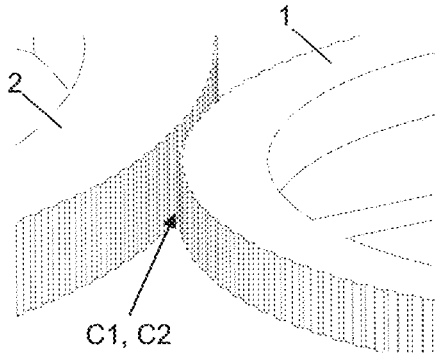

A sixth embodiment of a timepiece 130 is described hereinafter with reference to FIGS. 21 and 22. The timepiece comprises a timepiece movement 120. The movement comprises a timepiece mechanism 110, such as, for example, a chronograph mechanism or a chronograph module or a correction mechanism.

The timepiece mechanism 110 comprises a mechanical connection device 100.

The sixth embodiment differs from the preceding embodiments in that it is applied to a horizontal coupling device in which the axes A1 and A2 of the first and second components 1, 2 are parallel, or substantially parallel, such as to implement a coupling device, which is for example integrated in a chronograph horizontal coupling device.

In this sixth embodiment, the distance between centers A1-A2 can vary according to the coupled or non-coupled configuration of the coupling device. For this purpose, the component 1, pivoted according to an axis A1, is arranged on a coupling lever 4 which is mobile relative to the movement frame according to an axis A4. The return spring 3 returns the lever to a return position in which the first component 1 is in contact with the second component 2.

Thus, when the chronograph is interlocked, the area Z1 of the peripheral surface S1 of the drive component 1, engaged with the finishing chain of a timepiece movement, in particular with a chronograph drive wheel 5, is placed against the area Z2 of the peripheral surface S2 of the driven component 2. The components 1 and 2 can thus be assimilated to toothless wheels, the driving by friction of which is optimized by means of the micro-cavities C1 and C2 of the areas Z1, Z2, in particular by means of the flanks F1, F2 of the micro-cavities C1, C2 which are designed to cooperate by contact with one another.

An embodiment of this type is particularly advantageous within the context of a chronograph horizontal coupling device, which can be subject to the risk of fluttering, i.e. to a more or less random displacement of the second hand when the chronograph is interlocked, because of the size and geometry of the conventional toothing which takes part in this type of coupling.

In this case, the micro-structured surfaces S1 and S2 are cylindrical. Alternatively, these surfaces can form an angle relative to their respective axis of revolution A1, A2. Advantageously, the components 1 and can comprise resilient arms B1, B2, such as to generate pre-stressing which places the surfaces S1, S2 against one another, in the manner of the device disclosed in document EP3051364. Alternatively, this pre-stressing can be generated by any other return means. Also advantageously, the area Z1 of the surface S1 of the component 1 can also be designed to cooperate with a micro-structured area Z5 of the peripheral surface S5 of the chronograph drive wheel 5.

Preferably, in this sixth embodiment, the first micro-cavities C1 and the second micro-cavities C2, in particular flanks F1 of the first micro-cavities and flanks F2 of the second micro-cavities C2, are oriented prependicularly, or substantially perpendicularly, to the forces E transmitted from the first part to the second part at the contact between the first and second parts. Thus, in this sixth embodiment, the micro-cavities C1 and C2 are preferably micro-grooves which extend preferably parallel to the axes A1 and A2.

In this sixth embodiment, the first area Z1 is micro-structured on the exterior, and the second area Z2 is micro-structured on the exterior. However, one of the first and second areas could alternatively be micro-structured on the interior.

Figure 23:
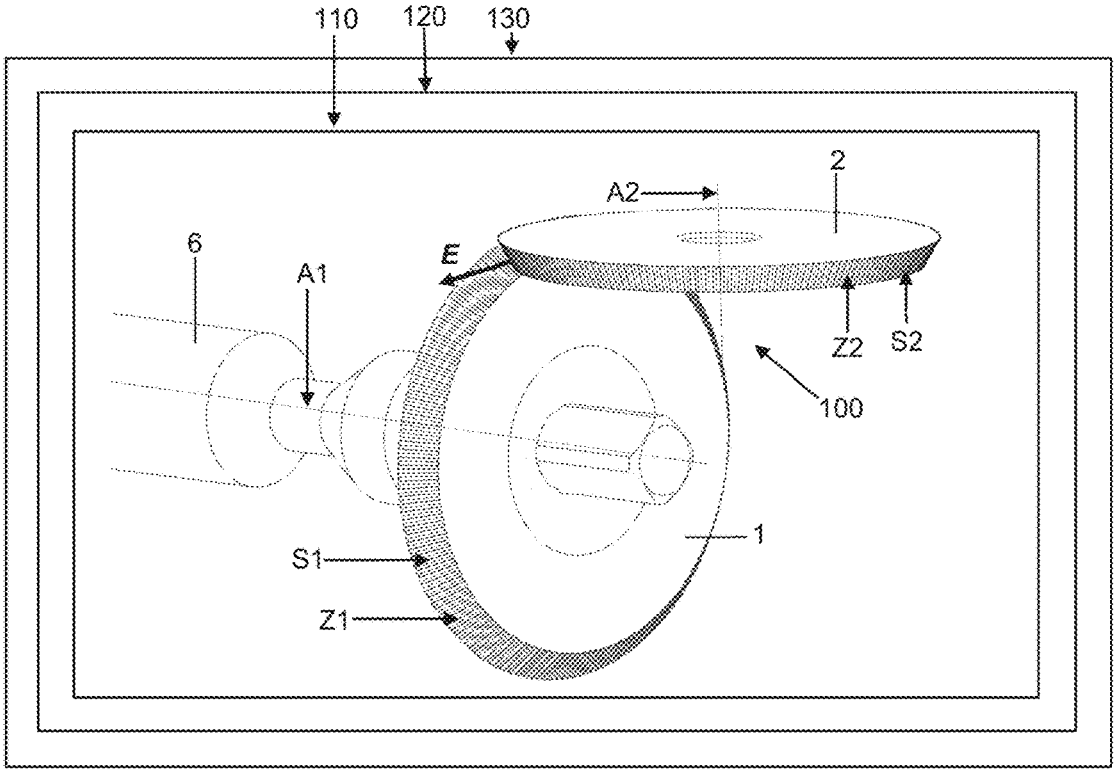
FIG. 23 is a view of a seventh embodiment of a timepiece according to the invention comprising a seventh embodiment of a mechanical connection device.
Figure 24:
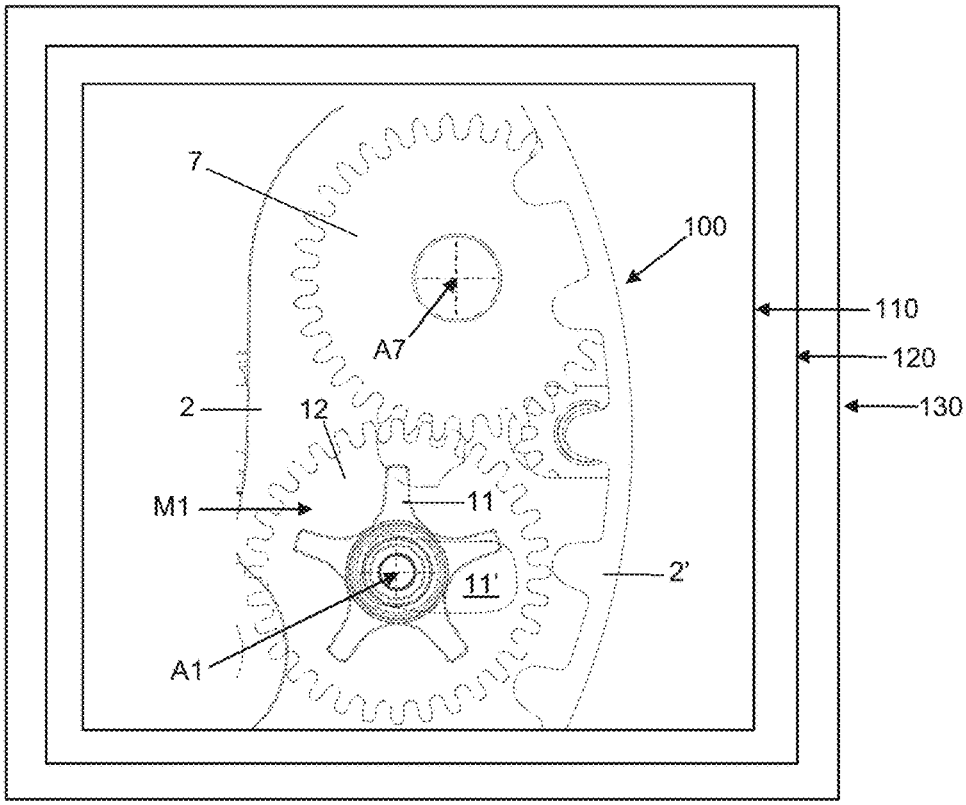
Figure 25:
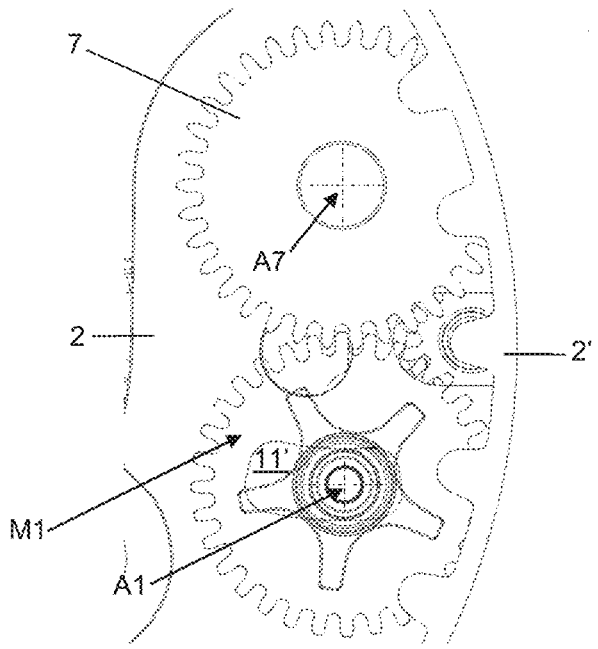

A seventh embodiment of a timepiece 130 is described hereinafter with reference to FIG. 23. The timepiece comprises a timepiece movement 120. The movement comprises a timepiece mechanism 110, such as, for example, a mechanism for winding and/or correction at the setting stem, or a correction mechanism.

The timepiece mechanism 110 comprises a mechanical connection device 100.

The seventh embodiment differs from the sixth embodiment in that the surfaces S1 and S2 on which the areas Z1 and Z2 are provided, having micro-cavities C1 and C2, are not cylinders. In fact, in this seventh embodiment, the surfaces S1 and S2 are cones or portions of a cone of revolution S1, S2. The areas Z1 and Z2 are each arranged on a frustum of these cones. The two cones (with surfaces S1, S2) can have the same top. The axes A1, A2 of the first and second components coincide, and in particular are perpendicular, such as to implement a coupling device, which for example is integrated in a coupling device at the winding mechanism setting stem.

In this embodiment, the component 1 can be displaced axially according to the axis A1, in accordance with the coupled or non-coupled configuration of the coupling device. For this purpose, the component 1 can for example be in the form of a winding mechanism pinion 1 which is integral with a setting stem 6 of the winding mechanism, which stem can be positioned axially by means of a conventional setting stem mechanism. The driven component 2 can adopt the form of a winding mechanism crown 2.

When the coupling is actuated, the area Z1 of the peripheral surface S1 of the drive component 1, engaged with the setting stem 6, is placed against the area Z2 of the peripheral surface S2 of the driven component 2, the axis of rotation A2 of which is fixed relative to the movement frame. The components 1 and 2 can thus be assimilated to toothless wheels, the driving by friction of which is optimized by means of the micro-cavities C1 and C2 of the areas Z1, Z2, in particular by means of the flanks F1, F2 of the micro-cavities C1, C2 which are designed to cooperate with one another.

An embodiment of this type is particularly advantageous within the context of a conventional mechanism for winding and/or correction at the setting stem, which can be subject to the risk of butting. This risk leads to a sensation of scraping during activation of the functions, or to axial blocking of the setting stem when the winding or adjustment chains are under tension. This risk is inherent in the size and geometry of conventional toothing involved in this type of coupling.

The micro-structured surfaces S1 and S2 are in this case preferably frusto-conical. The generatrices of the surfaces S1 and S2 can form the same angle. Preferably, the generatrices of the surfaces S1 and S2 form an angle of 45° relative to the axes A1 and A2. Alternatively, it will be appreciated that these surfaces can be cylindrical.

Preferably, in this seventh embodiment, the first micro-cavities C1 and the second micro-cavities C2, in particular flanks F1 of the first micro-cavities and flanks F2 of the second micro-cavities C2 are oriented prependicularly, or substantially perpendicularly, to the forces E transmitted from the first part to the second part at the contact between the first and second parts. Thus, in this seventh embodiment, the micro-cavities C1 and C2 are preferably micro-grooves which preferably extend respectively according to generatrices of the cones S1, S2.

In this seventh embodiment, the first area Z1 is micro-structured on the exterior, and the second area Z2 is micro-structured on the exterior.

An eighth embodiment of a timepiece 130 is described hereinafter with reference to FIGS. 24 to 28. The timepiece comprises a timepiece movement 120. The movement comprises a timepiece mechanism 110, such as, for example, a correction mechanism.

The timepiece mechanism 110 comprises a mechanical connection device 100.

The eighth embodiment differs from the preceding embodiments in that the first part 1 is a part which is fitted such as to be mobile relative to the frame, and in particular is a first disk or a first wheel, and the second part 2 is a part which is fitted fixed relative to the frame, and in particular is a frame blank. This therefore provides a catching device between the first part 1 and the second part 2.

The first part 1 is for example a drive part which is designed to cooperate with a driven disk 2', and also to cooperate with the second part 2. The disk 2' is for example a disk with indications of the dates. The first part 1 and the second part 2 are micro-structured.

Preferably, the axis A1 of the first part and the axis A2' of the disk 2' are parallel, or substantially parallel, such as to implement a one-way coupling device, which is used for example inside a mechanism for rapid correction of at least one calendar indication, for example indication of the dates. The distance between centers A1-A2' can vary according to the configuration of the correction mechanism (mechanical connection configuration or configuration without mechanical connection).

This mechanism comprises an intermediate correction wheel 7 which is engaged with the first part 1 of a disk M1 which can be displaced between two positions. For this purpose, the first part 1 is arranged inside a curved oblong cut-out 11' provided in the second part, which is preferably a blank 2, in particular a correction bridge 2. Thus, the first part 1 can go from a first position of non-correction represented in FIG. 24, to a second position of correction of the disk 2' for the dates represented in FIG. 25, according to the direction of rotation of a winding mechanism setting stem not represented, and can drive the intermediate wheel 7.

Thus, in this embodiment, the first part 1 and the bridge 2 are micro-structured such as to control, and in particular to maximize, the pivoting torque of the first part relative to the bridge, and thus guarantee the displacement of the first part 1 along the curved oblong cut-out, under the effect of the inversion of the direction of rotation of the winding mechanism setting stem.

More particularly, the disk M1 advantageously comprises a star wheel 11 for correction of the dates, a wheel 12 for correction of the dates, and the first part comprising a bush 1 or consisting of a bush 1. The star wheel 11 is designed to drive conventional toothing of the disk 2', the wheel 12 is engaged with the intermediate wheel 7, whereas the bush 1 is designed to be accommodated inside the oblong cut-out 11' in the correction bridge 2, and thus corresponds to the first part 1.

Figure 26:
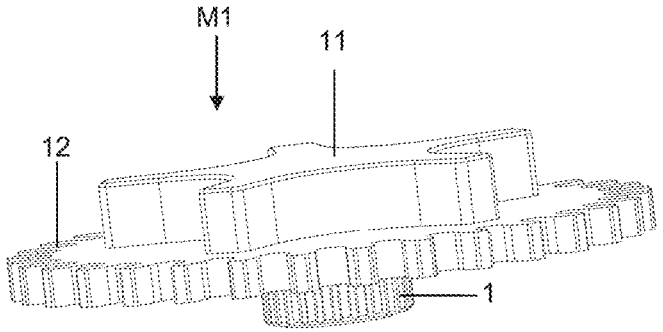
Figure 27:
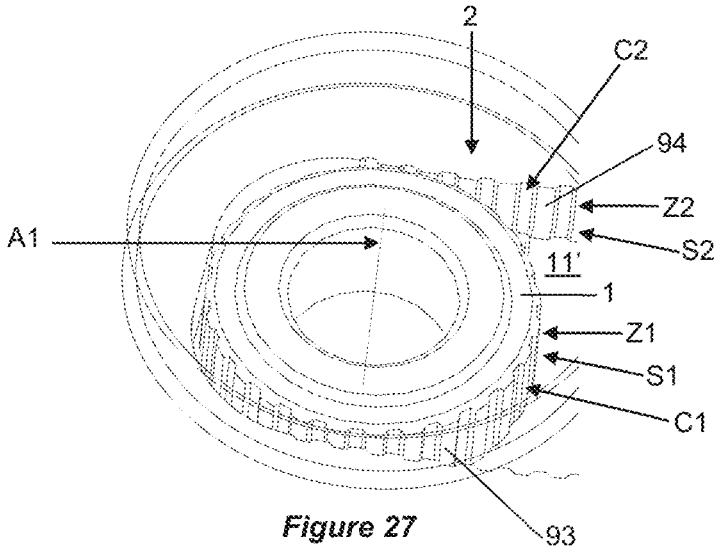

According to a first preferred variant embodiment, the first micro-structured area Z1 is formed on the periphery of the bush 1, as represented in FIGS. 26 and 27, and the second micro-structured area Z2 is formed on the flanks of the cut-out 11' in the bridge, as represented in FIGS. 26 and 27. Thus, the surface S1 is a cylinder of revolution, and the surface S2 is a cylinder, the generatrix curve of which is on the flanks of the cut-out 11' in the bridge. The micro-cavities C1, C2, in particular the flanks F1, F2 of the micro-cavities, are designed to cooperate with one another.

Preferably, in this first variant of the eighth embodiment, the first micro-cavities C1 and the second micro-cavities C2, in particular flanks F1 of the first micro-cavities and flanks F2 of the second micro-cavities C2, are oriented perpendicularly, or substantially perpendicularly, to the direction of the movement of the first part 1 relative to the second part, at the surfaces in which the micro-cavities are formed. Thus, in this eighth embodiment, the micro-cavities C1 and C2 are micro-grooves which preferably extend parallel to the axis A1.

In this first variant of the eighth embodiment, the first area Z1 is micro-structured on the exterior and the second area Z2 is micro-structured on the interior.

According to a second variant embodiment represented in FIG. 28, the micro-structured areas Z1, Z2 are formed on a flat surface S1 constituting at least part of a plate of the first part 12, and on a surface S2 constituting at least part of a face of the bridge 2. Thus, in this second variant, the first part comprises the wheel 12 or consists of the wheel 12. The micro-cavities C1 and C2 can in this case be formed by laser mitraillage for the purpose of increasing the roughness of areas Z1 and Z2 of the surfaces S1 and S2, and thus controlling, and in particular increasing substantially, the pivoting torque of the first part 1 relative to the bridge 2.

A method for execution of a device 100 or a mechanism 110 or a movement 120 or a timepiece 130 as previously described comprises the following steps:

- treating, in particular texturizing or structuring the first part 1 by means of a laser, in particular a femtosecond laser, in order to obtain the first micro-cavities C1; and
- treating, in particular texturizing or structuring the second part 2 by means of a laser, in particular a femtosecond laser, in order to obtain the second micro-cavities C2.

The method can comprise a prior step of coating of a first area of the first surface S1 of the first part with a friction-reduction layer, which in particular is based on carbon, and in particular is based on graphene, and/or a prior step of coating of a second area of the second surface S2 of the second part with a friction-reduction layer, which in particular is based on carbon, and in particular is based on graphene. Advantageously, the coating is thinner than the depth of the machining of the micro-cavities which are formed subsequently. Thus, the laser structuring then makes it possible to eliminate the coating from the micro-cavities C1, C2, in particular from the flanks F1, F2 of the micro-cavities, by carrying out their machining through the coating. An embodiment of this type then makes it possible to take advantage of the tribological and hardness properties of the coating in order to assist the cooperation of the micro-cavities during the activation of the coupling device, and to reduce the wear of the micro-cavities. Alternatively, the areas Z1, Z2 can be coated completely. In the two configurations, the coating can for example be a solid friction-reduction coating based on carbon, in particular based on graphene. In particular, the coating could be a DLC (Diamond-Like Carbon) coating, the coefficient of friction of which is known to be very low in contact with the materials of the movement, for example lower than 0.1, and the hardness of which is very high, and can for example be as much as approximately 90 GPa. Alternatively, the coating can be constituted by nanocrystalline diamond, or can incorporate carbon nanotubes.

Preferably, the micro-structured areas Z1, Z2 are obtained by means of the aforementioned treatment steps. These treatment steps make it possible to form networks of micro-cavities C1, C2 formed by means of a laser, preferably by means of a laser, the duration of the pulses of which is approximately a femtosecond. The duration of the pulses can in particular range from a femtosecond to a picosecond. The laser is put into motion so that it sweeps at least partially the surfaces S1, S2 of the components 1 and 2, and in particular sweeps the areas Z1 and Z2 of the components 1 and 2. Alternatively, the parts can be put into motion relative to the laser. It is also possible to conceive of a combination of movements of the laser and the parts 1 and 2, in a manner which is or is not synchronized.

In all the embodiments, the micro-structured areas Z1 and Z2 comprise micro-cavities C1, C2.

Figure 9:
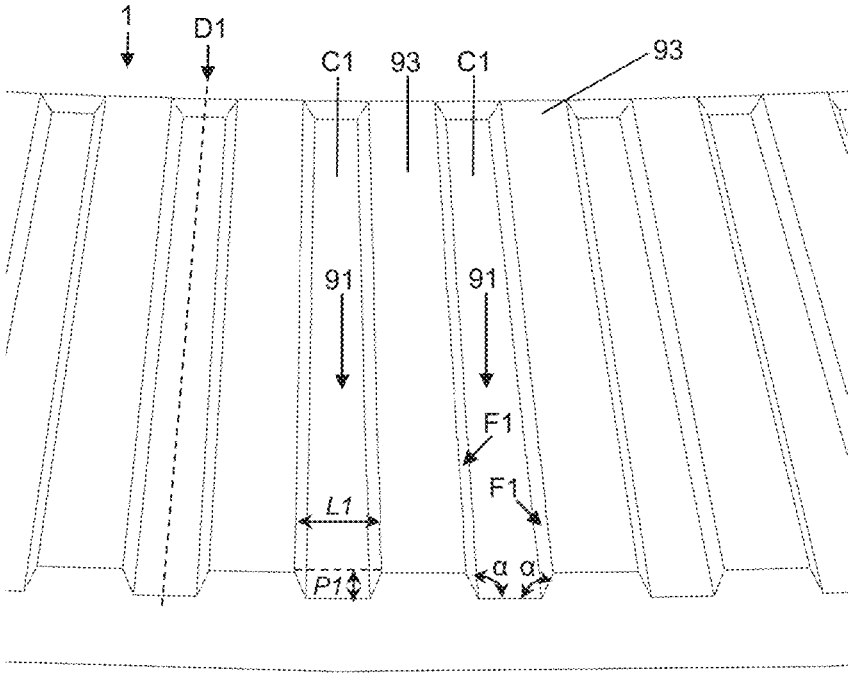

In all the embodiments, the micro-cavities C1 are advantageously micro-grooves and/or the micro-cavities C2 are advantageously micro-grooves. The micro-grooves can advantageously extend linearly, i.e. according to straight lines D1 as represented in FIG. 9. Alternatively, the micro-grooves can extend according to curves on the surfaces where they are formed.

Advantageously, in all the embodiments, the first micro-cavities have a depth of less than 100 μm, or less than 50 μm, or less than 25 μm, and/or the second micro-cavities have a depth of less than 100 μm, or less than 50 μm, or less than 25 μm. Also preferably, the first and second micro-cavities have the same depth or substantially the same depth.

Advantageously, in all the embodiments, the first micro-cavities have a width L1 of less than 200 μm, or less than 150 μm, or less than 100 μm, and/or the second micro-cavities have a width of less than 200 μm, or less than 150 μm, or less than 100 μm. Also preferably, the first and second micro-cavities have the same width or substantially the same width.

In the embodiments where the flanks of the micro-cavities touch upon one another, the width of the bottoms of the micro-cavities can be substantially equal to the width of the conformations separating two contiguous or adjacent micro-cavities.

In the first, second and third embodiments, advantageously the areas Z1 and Z2 comprise the same number of micro-cavities C1, C2. Alternatively, the areas Z1 and Z2 can comprise a different number of micro-cavities C1, C2.

In all the embodiments, advantageously, the micro-cavities C1 are in the form of notches, in particular with a depth P1 and a width L1.

In all the embodiments, advantageously, the micro-cavities C2 are in the form of notches, in particular with a depth P2 and a width L2.

In all the embodiments, advantageously, the micro-cavities C1, C2 have the same geometry. In particular, the depths P1 and P2 are equal or substantially equal, and the widths L1 and L2 are equal or substantially equal.

In all the embodiments, advantageously, the micro-cavities have flanks forming an angle $\alpha$ of between 90° and 160° from the bottoms of the first micro-cavities, and/or the second micro-cavities have flanks forming an angle $\alpha$ of between 90° and 160° from the bottoms of the second micro-cavities.

It will be appreciated that the geometry, in particular the depth P1, and/or the width L1, and/or the angle $\alpha$ of the micro-cavities C1 and/or C2 can vary over all of the areas Z1, Z2, and in particular they can vary along some or each of the micro-cavities. The notches formed by the micro-cavities and represented in FIG. 9 are symmetrical. It will be appreciated that they could be asymmetrical such as to give precedence to a direction of mechanical connection of the components 1 and 2. In such a case, the force which can be transmitted from the first part to the second part can be different in a first direction of driving of the first part and in a second direction of driving of the first part, the second direction being opposite that of the first direction.

In the different embodiments, the micro-cavities C1, C2 are preferably designed to cooperate in dry conditions.

In the different embodiments, preferably, in the first area Z1, two first contiguous micro-cavities are separated by a first interposed conformation which can form a top 93, and/or, in the second area Z2, two second contiguous micro-cavities are separated by a second interposed conformation which can form a top 94. In the different embodiments, preferably, the width of interposed conformations separating two contiguous or adjacent micro-cavities is less than 150 μm, or less than 100 μm, or less than 50 μm. For example, the interposed conformations can be reduced to an edge or substantially to an edge.

In the different embodiments, preferably, the micro-cavities can also have "submicronic" dimensions, in particular "nanometric" dimensions. Thus, the term "micro-cavity" is used interchangeably for structures with a size smaller than a micron, or for structures of approximately a micron, or for structures with a size larger than a micron. The same applies to the term "micro-groove".

Figure 10:
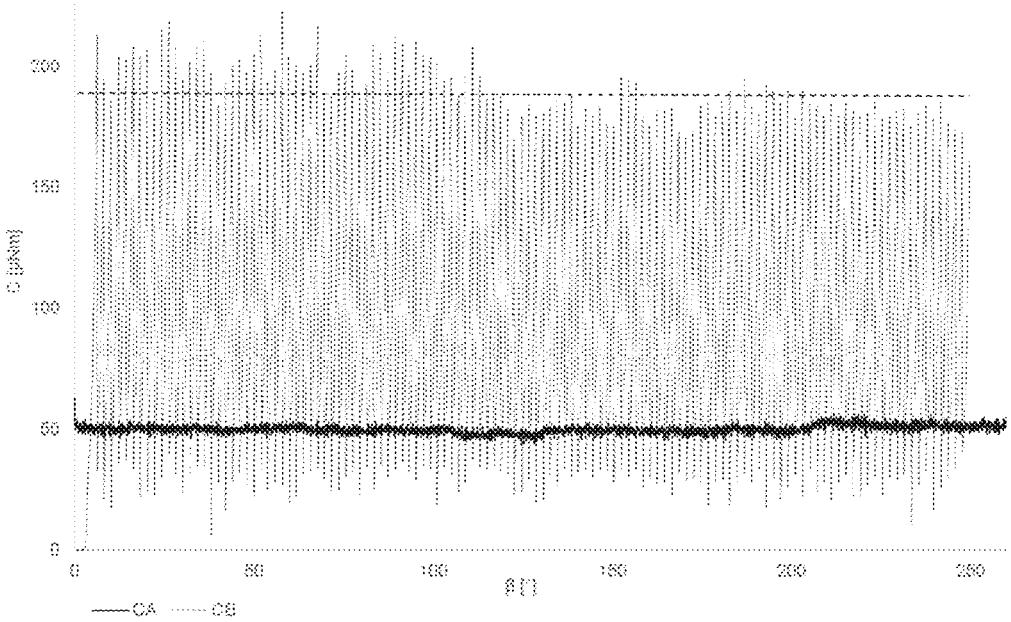

Practical tests have been able to be carried out such as to show the gains provided by a solution according to the first embodiment. FIG. 10 illustrates a graph comparing the torque CA of resistance of a coupling known in the prior art, such as the one illustrated in FIGS. 1 and 2, but which would not have the micro-cavities, and the torque CB of resistance of the coupling such as the one illustrated in FIGS. 1 and 2, with surfaces S1 and S2 comprising areas Z1 and Z2 which are provided with micro-cavities C1, C2 such as those represented more particularly in FIGS. 3 to 9. "Resistance torque" means the minimum torque necessary to make the first part turn by an angle $\beta$ relative to the second part 2 in the coupled configuration of the coupling device (or mechanical connection configuration).

FIG. 10 indicates a gain of approximately a factor of 4 between the mean torque CA according to the angle $\beta$, and the mean of the peaks of the torque signal CB according to the angle $\beta$. Thus, for the same coupling spring 3, the transmission torque of the coupling is increased by a factor of 4.

Torque measurements have also been carried out on couplings wherein the second part 2 comprises only two micro-cavities C2 equidistantly distributed around the axis A2, and the geometries of which are identical to those of the 180 micro-cavities C1 of the first part 1. It is found that the torque signal CB is similar to that illustrated by FIG. 10. Thus, it is also found that, for the same coupling spring 3, the transmission torque of the coupling is increased by a factor of 4 relative to a coupling known in the prior art.

In the different embodiments, the micro-cavities C1 and C2 cooperate with one another. In particular, they cooperate by means of an obstacle, in particular by means of an obstacle at their flanks.

The micro-cavities do not form coupling teeth. Nor can the micro-cavities be assimilated to coupling teeth, in particular because of their geometry. In the five first embodiments, the contact of the flanks F1, F2 of micro-cavities C1, C2 is permanent when the connection device is actuated. For example, when the connection device is actuated, a significant number, in particular a number of more than 3, or more than 5, or more than 10, or all the micro-cavities of one out of the first and second parts are in contact, in particular in permanent contact, with the micro-cavities of the other part.

Preferably, the devices of the first, second, third, fourth and fifth embodiments are connection devices. Advantageously, the first and second parts are put into motion as a single part (apart from sliding) when the device is actuated, i.e. the first and second parts continue to be fixed to one another (apart from sliding).

In the sixth, seventh and eighth embodiments, the flanks F1 are brought into contact consecutively with flanks F2 which are contiguous when the device is actuated, which assists the adhesion of the surfaces S1, S2, in particular of the areas Z1, Z2.

In the sixth, seventh and eighth embodiments, when the connection device is actuated, a limited number, in particular a number of less than 10, or less than 5, or less than 3, of micro-cavities of one out of the first and second parts are in contact, in particular in sequential contact, with the micro-cavities of the other part.

Preferably, the connection devices of the sixth and seventh embodiments are transmission devices.

Advantageously, the first and second parts are put into motion with dependence on one another. Preferably, the two parts roll on one another, in particular without sliding relative to one another. Preferably, a return element returns the first area and second area into contact with one another. Also preferably, no stop is provided in order to limit the approach of the first and second parts to one another. In particular, in the sixth embodiment, preferably, no stop is provided to maintain a minimum distance between centers between the first and second parts.

Preferably, the device according to the eighth embodiment is a particular connection device. It makes it possible to create friction between the first and second parts.

Preferably, in all the embodiments, when the force applied by the first part to the second part is too great, the first part is displaced independently from the second part, i.e. sliding takes place between the parts, without however one or the other of the first and second parts being damaged. In this situation, two flanks of micro-cavities cease to cooperate with one another, and the parts slide relative to one another until at least one of the flanks of the first part cooperates again by contact, in particular by means of an obstacle, with at least one of the flanks of the second part.

In the different embodiments, the micro-cavities are used in cooperation with one another, either in order to form a mechanical connection of the type consisting of mechanical driving of one part by another (this is the case for the seven first embodiments), or in order to form a mechanical connection of the friction or catching type of one part on another (this is the case for the eighth embodiment).

In certain embodiments, the mechanical connection device can be placed selectively:

in a first mechanical connection configuration, in which the first and second areas are in contact with one another, and in particular are returned by a return force against one another; and in a second configuration, of rupture of the connection, in which the first and second areas are maintained spaced from one another.

In the case of a coupling, the first configuration is a coupled configuration and the second configuration is an uncoupled configuration.

In other embodiments, the mechanical connection device can be maintained permanently (except when it is dismantled or for a maintenance operation) in a mechanical connection configuration in which the first and second areas are in contact with one another.

Preferably, the formation of micro-cavities in areas of the parts can make it possible to provide decorative effects in these areas and/or optical effects in these areas, in particular moiré effects. These effects are advantageously used in particular in order to personalize the appearance of the parts.

The formation of the micro-cavities makes it possible to form areas where the roughnesses or surface states are controlled. These surface states or roughnesses are advantageously used to optimize, control or maximize friction forces between different parts.

In this document, "mechanical connection configuration" advantageously means a configuration where the first part and the second part move as a single part or stay in an idling position as a single part, at least when an effort between these first and second parts remains below an effort threshold. The goal of the first and second areas is to maximize this effort threshold.

The invention claimed is:

1. A mechanical connection device, comprising:

a first part comprising a first area with first micro-cavities; and a second part comprising a second area with second micro-cavities;

the first and second areas being in contact with one another in a mechanical connection configuration, wherein the widths of the micro-cavities are less than 200 μm;

the micro-cavities cooperate as an obstacle at their flanks imparting a friction type or a catching type mechanical connection, and wherein when a force applied by the first part to the second part exceeds a threshold, the first part slides with respect to the second part without damage;

wherein the first part and the second part include interposed conformations separating adjacent ones of said first micro cavities of the first part and separating adjacent ones of said second micro cavities of the second part, and wherein said interposed conformations each have a top surface that is flat or planar.

2. The device as claimed in claim 1, wherein the first micro-cavities are micro-grooves and/or the second micro-cavities are micro-grooves.

3. The device as claimed in claim 1, wherein the first micro-cavities have a depth of less than 100 μm, and/or the second micro-cavities have a depth of less than 100 μm, and/or the first and second micro-cavities have the same depth or substantially the same depth, and/or the first and second micro-cavities have the same width or substantially the same width.

4. The mechanical connection device as claimed in claim 3, wherein each of said first micro-cavities have a depth of less than 100 μm and each of said second micro-cavities have a depth of less than 100 μm.

5. The device as claimed in claim 1, wherein the micro-cavities have flanks forming an angle of between 90° and 160° from bottoms of the first micro-cavities, and/or the second micro-cavities have flanks forming an angle of between 90° and 160° from bottoms of the second micro-cavities.

6. The device as claimed in claim 1, wherein the first micro-cavities and the second micro-cavities are oriented perpendicularly, or substantially perpendicularly, to forces transmitted from the first part to the second part at a contact between the first and second parts, or the first micro-cavities and the second micro-cavities are oriented parallel, or substantially parallel, to the forces transmitted from the first part to the second part at the contact between the first and second parts.

7. The device as claimed in claim 1, wherein the first part is fitted so as to be mobile relative to a frame, and/or the second part is fitted so as to be mobile relative to the frame, or fitted fixed relative to the frame.

8. The device as claimed in claim 1, wherein the first area forms a portion of a first surface of the first part, and/or the second area forms a portion of a second surface of the second part.

9. The device as claimed in claim 8, wherein the portion of the first surface is micro-structured on the interior or on the exterior, and/or the portion of the second surface is micro-structured on the interior or exterior.

10. The device as claimed in claim 1, wherein the device comprises a return element for resilient return of the first area into contact against the second area.

11. A method for production of a device as claimed in claim 1, wherein the method comprises:

treating a first part by means of a laser, in order to obtain first micro-cavities; and treating a second part by means of a laser, in order to obtain second micro-cavities.

12. The production method as claimed in claim 11, wherein the method comprises a prior action of coating the first area with a friction-reduction layer, and/or of coating the second area with a friction-reduction layer.

13. The production method as claimed in claim 12, wherein the friction-reduction layer coated on the first area is based on carbon, and/or the friction-reduction layer coated on the second area is based on carbon.

14. The production method as claimed in claim 12, wherein the friction-reduction layer coated on the first area is based on graphene, and/or the friction-reduction layer coated on the second area is based on graphene.

15. A device obtained by implementation of the method as claimed in claim 11.

16. The production method as claimed in claim 11, wherein the treating of the first part is texturizing or structuring the first part and the treating of the second part is texturizing or structuring the second part.

17. A timepiece mechanism, comprising a mechanical connection device as claimed in claim 1.

18. A timepiece movement comprising a mechanism as claimed in claim 17.

19. A timepiece comprising a movement as claimed in claim 18.

20. The timepiece mechanism as claimed in claim 17, wherein the mechanism is selected from the group consisting of a) a chronograph coupling, including a chronograph horizontal or vertical or radial coupling, b) a mechanism for correction at the setting stem, c) a mechanism for correction of the date, and d) a barrel.

21. The mechanical connection device as claimed in claim 1, which is a mechanical connection device for a timepiece or a mechanical transmission device for a timepiece.

22. The mechanical connection device as claimed in claim 1, wherein said first and second micro cavities include laser-formed notches within said first part and said second part, respectively.

23. The mechanical connection device as claimed in claim 22, wherein said interposed conformations form a top surface.

24. The mechanical connection device as claimed in claim 22, wherein said interposed conformations each have a top surface that is a regulated surface shape.

25. A mechanical connection device, comprising:

a first part comprising a first area with first micro-cavities; and a second part comprising a second area with second micro-cavities;

the first and second areas being in contact with one another in a mechanical connection configuration, wherein the widths of the micro-cavities are less than 200 μm;

the micro-cavities cooperate as an obstacle at their flanks imparting a friction type or a catching type mechanical connection, and wherein when a force applied by the first part to the second part exceeds a threshold, the first part slides with respect to the second part without damage;

wherein said first and second micro cavities include notches within said first part and said second part, respectively, wherein the first part and the second part include interposed conformations separating adjacent ones of said first micro cavities of the first part and separating adjacent ones of said second micro cavities of the second part, wherein said interposed conformations are each flat or planar and have a width that is greater than a depth of adjacent micro cavities.

26. A mechanical connection device, comprising:

a first part comprising a first area with first micro-cavities; and a second part comprising a second area with second micro-cavities;

the first and second areas being in contact with one another in a mechanical connection configuration, wherein the widths of the micro-cavities are less than 200 μm;

the micro-cavities cooperate as an obstacle at their flanks imparting a friction type or a catching type mechanical connection, and wherein when a force applied by the first part to the second part exceeds a threshold, the first part slides with respect to the second part without damage;

wherein said micro-cavities each include a flat bottom wall and angled flank walls extending from opposite sides of said flat bottom wall, wherein a width of the flat bottom wall is greater than a height of each of said flank walls.

* * * * *